US006568721B2

(12) United States Patent
Fisher

(10) Patent No.: US 6,568,721 B2
(45) Date of Patent: May 27, 2003

(54) LATCH ASSEMBLY AND LATCH ARRANGEMENT

(75) Inventor: Sidney Edward Fisher, Shirley (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 09/853,330

(22) Filed: May 11, 2001

(65) Prior Publication Data

US 2001/0050485 A1 Dec. 13, 2001

(30) Foreign Application Priority Data

May 13, 2000 (GB) ..... 0011456

(51) Int. Cl.[7] ..... E05C 3/16

(52) U.S. Cl. ..... 292/216; 292/DIG. 57; 292/201; 292/199

(58) Field of Search ..... 292/216, 201, 292/199, DIG. 57; 70/264; 74/665 C, 416, 530, 534

(56) References Cited

U.S. PATENT DOCUMENTS 4,390,197 A * 6/1983 Butts ..... 292/144
4,973,091 A * 11/1990 Paulson ..... 292/51
4,997,221 A * 3/1991 Tolle ..... 292/275
5,090,750 A * 2/1992 Lindqvist ..... 292/7
5,305,969 A * 4/1994 Odell ..... 292/129.5
5,618,069 A * 4/1997 Konchan ..... 292/216

FOREIGN PATENT DOCUMENTS

| | | |
|---|---|---|
| EP | 0 978 609 A | 2/2000 |
| JP | 09 137911 | 11/1998 |
| WO | WO 95/09289 | 4/1995 |
| WO | WO 99/10616 | 3/1999 |

* cited by examiner

*Primary Examiner*—Gary Estremsky
(74) *Attorney, Agent, or Firm*—Carlson, Gaskey & Olds

(57) ABSTRACT

A latch assembly including a latch bolt moveable between a closed position at which it is capable of retaining a striker and a open position at which it is capable of releasing a striker, the latch assembly further including a pawl moveable between a retaining position at which it is capable of retaining the latch bolt in at least it closed position and a released position at which the latch bolt is free to move between its open and closed position, in which the pawl is rotatably mounted via a rotating element bearing.

18 Claims, 2 Drawing Sheets

LATCH ASSEMBLY AND LATCH ARRANGEMENT

BACKGROUND OF THE INVENTION

The present invention relates to latch assemblies and latch arrangements in particular for use on car doors.

Manufacturers of cars have been endeavoring to reduced in-car noise, and in particular wind induced in-car noise. One way of achieving this is to provide for door seals which, when a door is in the fully closed position exert a higher force between the door and adjacent door surround.

However, the problem with such arrangement is that it becomes increasingly difficult to unlatch the door since those components that secure the door in a latched position e.g. a latch bolt (such as a claw) and a pawl, are under increased load resulting in higher friction. In particular where the door is to be opened by a power actuator, larger and more expensive power actuators are required to be specified in order to be ensure correct unlatching of the door.

SUMMARY OF THE INVENTION

An object of the present invention is to provide a latch assembly and a latch arrangement which can be released more easily than known latch assemblies and latch arrangements.

Thus according to the present invention there is provided a latch assembly including a latch bolt moveable between a closed position at which it is capable of retaining a striker and an open position at which it is capable of releasing a striker, the latch assembly further including a pawl moveable between a retaining position at which it is capable of retaining the latch bolt in at least it closed position and a released position at which the latch bolt is free to move between its open and closed position, in which the pawl is rotatably mounted via a rotating element bearing.

The applicant is the first to realize that significant friction forces are developed at the pivot point of a pawl and therefore these forces can be reduced by installing a rotating element bearing at this position.

Preferably the rotating element bearing inner race is integral with the pawl pivot pin.

Advantageously such an arrangement means that a separate outer race and or inner race need not be provided. The applicant is the first to realize that the material that the pawl and pawl pivot pin are made from is of sufficient quality to act as bearing race material. In particular the structural integrity of the pawl and pawl pivot pin are important when the vehicle is involved in a collision, in as much as their failure could result in the door opening thus jeopardizing the safety of the car occupants and it is for this reason that they tend to be manufactured from high grade steel.

According to a further aspect of the present invention there is provided a latch assembly including a first release lever being pivotable about a first axis and having plurality of first gear teeth and a second release lever being pivotable about second axis and having a plurality of second gear teeth for co-operation with the plurality of first gear teeth, operation of the first release lever causing the second release lever to unlatch the latch in which the first axis is not parallel to the second axis.

Thus where it is necessary for the forces acting via a transmission path to turn through an angle this aspect of the present invention provides for a significant reduction in friction forces.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
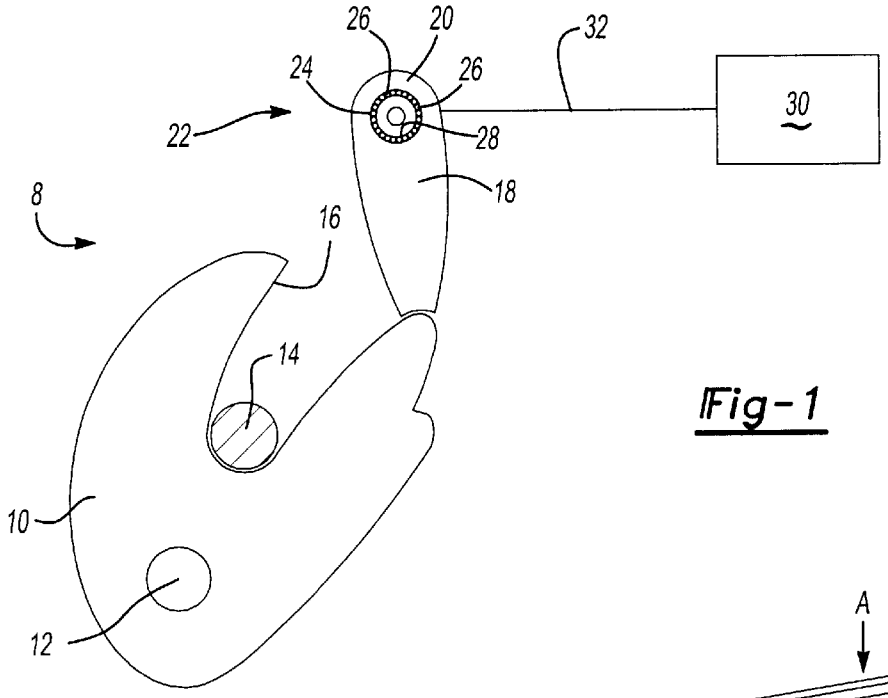
FIG. 1 is a schematic view of a claw and pawl of a latch assembly according to the present invention.

With reference to FIG. 1 there is shown a latch bolt in a form of a claw 10 pivotable about a claw pin 12 between a closed position (as shown in FIG. 1) wherein a striker 14 is retained in a mouth 16 of the claw and an open position (not shown) wherein the striker is no longer retained in the mouth 16.

A pawl 18 is further pivotable about a pawl pivot pin 20 between a retaining position (as shown in FIG. 1) wherein it prevents the claw from rotating in an anticlockwise direction as shown in FIG. 1 thus securing the striker 14, to a released position wherein the pawl no longer contacts the claw, thus allowing the claw to rotate in an anticlockwise direction as shown in FIG. 1 thus releasing the striker.

In this case the pawl 18 is pivotally mounted on the pawl pivot pin by a rotating element bearing shown generally as item 22. In this case the rotating element bearing comprises an outer race 24 which is integral with the pawl 18, rotating elements 26 in this case being needle rollers, and an inner race 28 being integral with the pawl pivot pin 20. In further embodiments the rotating elements could be of another form, such as ball bearings or roller bearings.

Also in further embodiments a separate outer bearing race could be provided which is rotationally secured in a hole of the pawl for example by an interference press fit.

In yet further embodiments a separate inner race could be provided which is rotationally secured to the pawl pivot pin, for example by an interference press fit.

In this case the pawl is connected to a power actuator 30 (shown schematically) via a connection means 32 (again shown schematically). Operation of the power actuator moves the pawl from its retained position to its release position thereby allowing release of the striker.

In particular the applicant is the first to realize that by providing a relatively complicated bearing arrangement for the pawl (when compared to known plain bearing arrangement) then saving can be made in terms of cost and size when specifying the power actuator since the forces required to open the door are now reduced and thus a smaller and lesser power actuator can be specified.

Figure 2:
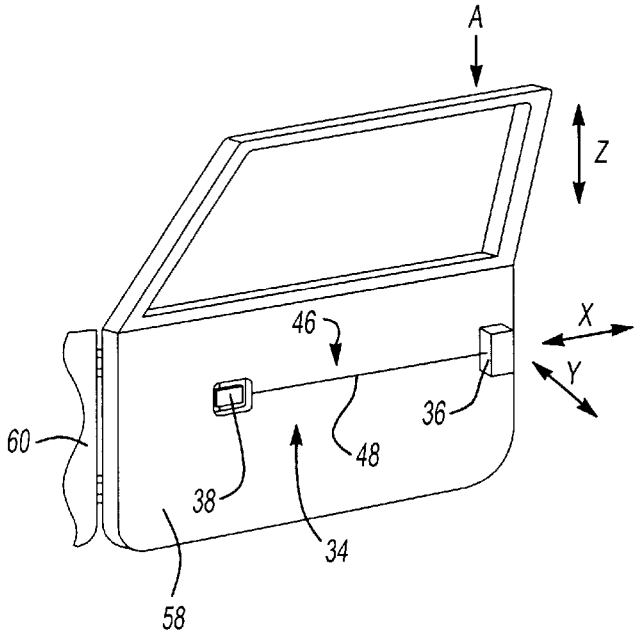
FIG. 2 is a isometric schematic view of a door including a latch arrangement according to the present invention.
Figure 3:
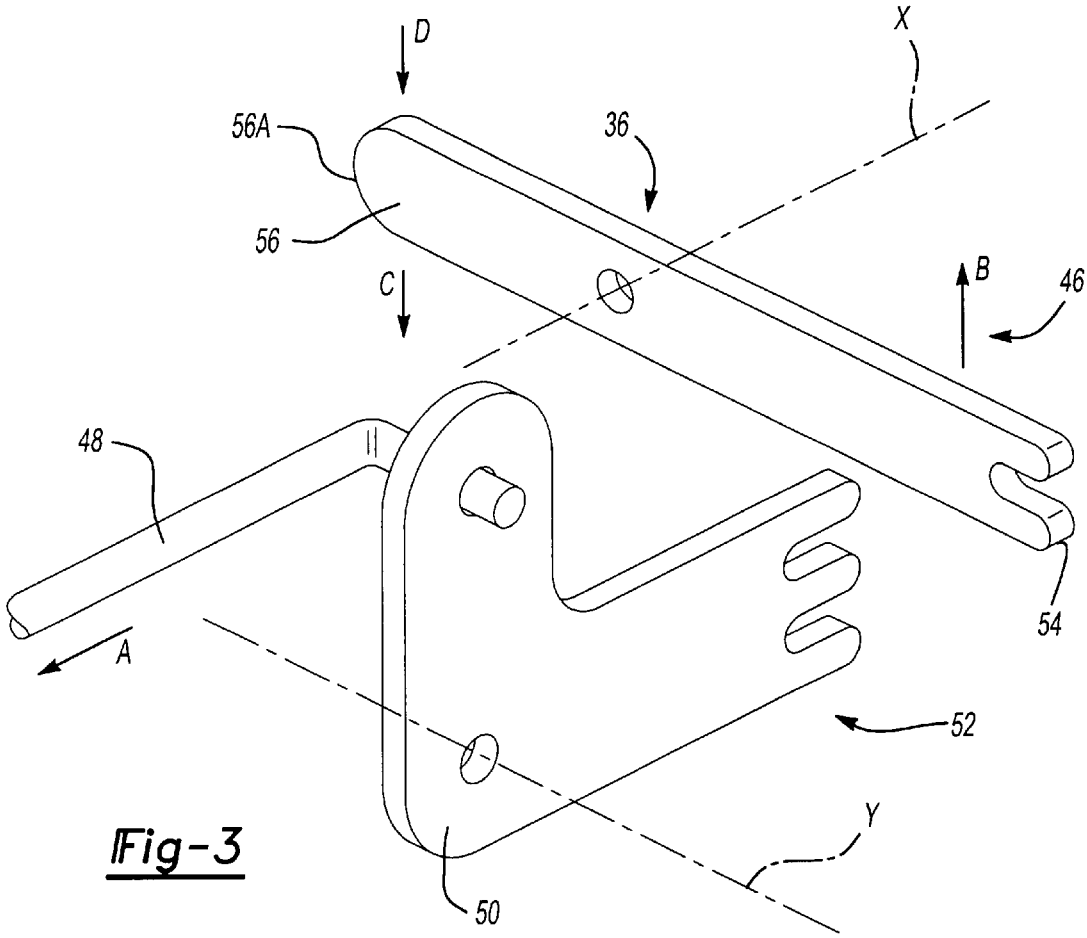
FIG. 3 is schematic view of part of FIG. 2.

With reference to FIGS. 2 and 3 there is shown a latch arrangement shown generally as item 34 including a latch assembly 36.

Figure 4:
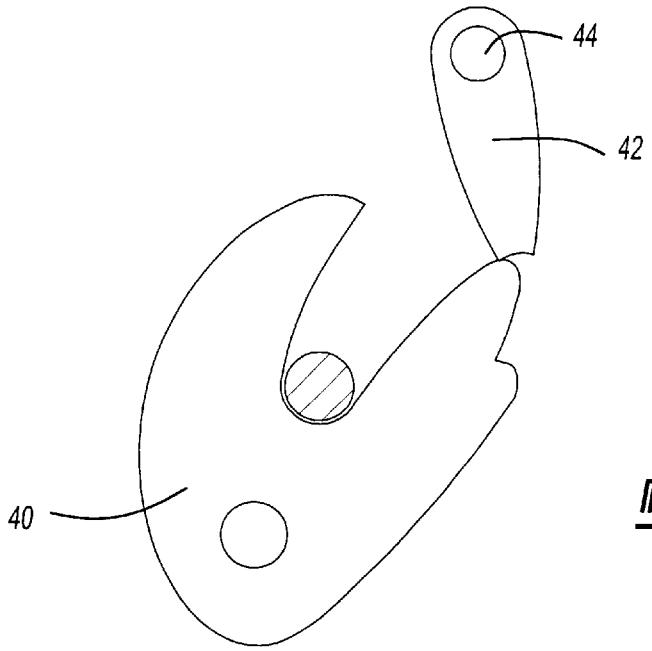
FIG. 4 is a front view of the pawl in the release position allowing the claw to rotate.

As shown in FIG. 4, the latch assembly 36 includes a latch bolt 40 and a pawl 42, operation of which is similar to claw 10 and pawl 18 as described above.

In particular is should be noted tat in this case pawl 42 is mounted by a plain beating arrangement on pawl pivot pin 44. Returning to FIG. 2, the latch arrangement further includes an inside door handle 38 which is connected to pawl 42 by a transmission path 46 (only part of which is shown).

Transmission path 46 includes a rod 48 which connects the inside door handle to an inside release lever 50 (also of the transmission path). It should be understood that the term release lever is to be understood as a lever which is situated in a transmission path between an inside door handle and the pawl but which is not in the transmission path between an outside door handle and a pawl.

Inside release lever 50 includes an array of teeth 52 which are engagable with an array of teeth 54 of a latch release lever 56 pivotally mounted on the latch assembly 36. It should be understood that the term latch release lever refers to a lever which is situated in a transmission path between an inside handle and the pawl, and is also in the transmission path between an outside handle and the pawl. Thus upon operation of the inside door handle end 56A of latch release lever 56 is caused to move downward in the direction of arrow C. End 56A ultimately connected to the pawl 42 by further components of the latch assembly 36 such that it causes the pawl to move to its released position allowing the claw 40 to rotate in an anticlockwise direction as shown in FIG. 4 thus releasing the striker.

An outside door handle (not shown) has a transmission path which acts in the direction of arrow D on end 56A of latch release lever 56 thus also causing the claw 40 to release the striker.

It will be noted from FIG. 2 that the latch arrangement 34 is mounted on a door 58 of a vehicle 60 (only part of which is shown).

It is convenient to define axis of the vehicle as follows:

X axis is defined as the fore and aft direction:

The Y axis is defined as the lateral i.e. side to side direction:

And the Z is defined as the vertical direction.

It can be seen that the door defines a major plain which is substantially parallel to the plain defined by the X and Z axes.

Furthermore the rod 48 lies substantially parallel to the Z axis, the inside release lever 50 is pivotable about an axis substantially parallel to the Y axis.

Figure 2A:
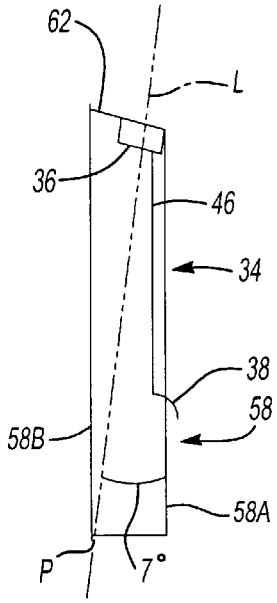
FIG. 2*a* is a section view of the door of FIG. 2 taken in the direction of arrow A.

FIG. 2A shows a cross section view of door 58. In particular it can be seen that door 58 has an inner skin 58A and an outer skin 58B.

The door is pivoted about effective pivot point P. The latch assembly 36 is mounted on a rear face 62 of the door and a line L joining effective pivot point P with latch assembly 36 is perpendicular to the plane of rear face 62.

In view of the fact that the effective pivot point P is towards an outer portion of the door and the latch assembly is towards an inner portion of the door it can be seen that line L is angled (in this case at 7°) relative to the plain of the inner skin 58A. As such the inner skin 58A is angled relative to the rear face 62 by 97° and thus inside release lever 50 is similarly pivoted about an axis which is at 97° to the axis about which latch release lever 56 pivots.

In further embodiments the angle between the door inner skin and the rear face may vary. In particular the angle may be 110° and similarly the angle between the axis of rotation of the inside release lever and latch release lever can be up to 110°.

It is preferable that the axis of rotation of the inside release lever intersects the axis of rotation of latch release lever, but this need not be the case. In particular it is possible for these axes to be skew relative to each other whilst the first and second gear teeth can still co-operate to open the latch.

In this particular case the arrays of teeth 52 and 54 (shown schematically) are of involute bevel form. Thus as the inside door handle 38 is operated the bevel involute surfaces of the teeth mesh together and during at least part of the opening movement of the inside release handle a rolling action occurs between the contacting involute bevel teeth. This rolling action significantly reduces friction between the inside release lever 50 and the latch release lever 56 thus enabling the door to be opened more easily.

In particular where the latch is opened by an actuator, the power actuator can act through the gear teeth.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A latch assembly comprising: a latch bolt moveable between a closed position at which said latch bolt is capable of retaining a striker and an open position at which said latch bolt is capable of releasing a striker, the latch assembly further including a pawl pivotable about a pawl pivot pin moveable between a retaining position at which said pawl is capable of retaining the latch bolt in at least said closed position and a released position at which the latch bolt is free to move between said open and closed position, in which the pawl is rotatably mounted via a rotating element bearing, wherein the rotating element bearing includes at least one of an inner race integral with the pawl and an outer race integral with the pawl pivot pin.

2. A latch assembly as defined in claim 1 in which the rotating element bearing includes needle roller rotating elements.

3. A latch assembly as defined in claim 1 further including a power actuator operable to move the pawl to said released position.

4. A latch assembly as recited in claim 1 wherein the rotating element bearing includes an inner race integral with the pawl and an outer race integral with the pawl pivot pin.

5. A latch assembly comprising: a first release lever being pivotable about a first axis and having plurality of first gear teeth and a second release lever being pivotable about second axis and having a plurality of second gear teeth for co-operation with the plurality of first gear teeth, operation of the first release lever causing the second release lever to unlatch the latch in which the first axis is not parallel to the second axis.

6. A latch assembly as defined in claim 5 in which the first axis is angled between 70° and 110° relative to the second axis.

7. A latch assembly as defined in claim 5 in which the first axis is substantially perpendicular to the second axis.

8. A latch assembly as defined in claim 5 in which the first axis is skew relative to the second axis.

9. A latch assembly as defined in claim 5 in which the plurality of first gear teeth have a substantially involute form.

10. A latch assembly as defined in claim 5 in which the plurality of second gear teeth have a substantially involute gear form.

11. A latch assembly as defined in claim 5 in which the first release lever is an inside release lever.

12. A latch assembly as defined in claim 11 in which the first axis is substantially perpendicular to a major plane of an associated door.

13. A latch assembly as defined in claim 12 in which the second axis lies substantially in a fore and aft direction of an associated door.

14. A latch assembly as defined in claim 5 in which the second release lever is a latch release lever.

15. A latch assembly as defined in claim 14 in which the second axis lies in a major plane of an associated door.

16. A latch assembly as defined in claim 15 in which the second axis is substantially horizontal.

17. A latch assembly as defined in claim 5 in which the plurality of first gear teeth and the plurality of second gear teeth provide a bevel gear arrangement.

18. A latch assembly as defined in claim 5 further including a latch bolt moveable between a close position at which it is capable of retaining a striker and an open position at which it is capable of releasing a striker, a latch assembly further including a pawl moveable between a retaining position at which it is capable of retaining latch bolt in at least is closed position and a released position at which the latch bolt is free to move between its open and closed position, in which the latch assembly further includes a power actuator operable to move the pawl to its released position.

* * * * *

UNITED STATES PATENT AND TRADEMARK OFFICE

CERTIFICATE OF CORRECTION

PATENT NO. : 6,568,721 B2
DATED : May 27, 2003
INVENTOR(S) : Sidney Edward Fisher It is certified that error appears in the above-identified patent and that said Letters Patent is hereby corrected as shown below:

Column 6,
Line 8, “retaining latch” should be -- retaining a latch --.
Line 9, “is” should be -- its --.

Signed and Sealed this

Twenty-second Day of July, 2003

JAMES E. ROGAN
*Director of the United States Patent and Trademark Office*